US006666394B1

(12) United States Patent
Süssegger et al.

(10) Patent No.: US 6,666,394 B1
(45) Date of Patent: Dec. 23, 2003

(54) MILLING INSTALLATION

(75) Inventors: Albert Süssegger, Eitorf (DE); Siegfried Strasser, Much (DE)

(73) Assignee: KHD Humboldt Wedag AG, Cologne (DE)

( * ) Notice: Subject to any disclaimer, the term of this patent is extended or adjusted under 35 U.S.C. 154(b) by 525 days.

(21) Appl. No.: 09/692,016

(22) Filed: Oct. 19, 2000

(30) Foreign Application Priority Data

Oct. 9, 1999 (DE) ..... 199 48 725

(51) Int. Cl.[7] ..... B02C 19/12

(52) U.S. Cl. ..... 241/65; 209/143; 241/79.1; 241/80

(58) Field of Search ..... 241/79.1, 80, 97, 241/152.2, 57, 65; 209/143

(56) References Cited

U.S. PATENT DOCUMENTS 5,392,998 A * 2/1995 Suessegger et al. ..... 241/79.1
6,347,707 B1 * 2/2002 Sussegger et al. ..... 209/143

* cited by examiner

*Primary Examiner*—Mark Rosenbaum
(74) *Attorney, Agent, or Firm*—Sonnenschein Nath & Rosenthal

(57) ABSTRACT

In the production of meal-fine products by a milling process the milling material generated in a comminuting device is ordinarily separated at the desired grain size in a downstream sifter and the fine material (meal-fine product) obtained here is then separated in the fine material separating device from the sifting air. According to the invention it is proposed to construct the sifter as a V-sifter and to connect this latter, without interposition of the otherwise ordinarily used pipelines, directly with the fine material separating device, preferably an electro-filter.

16 Claims, 1 Drawing Sheet

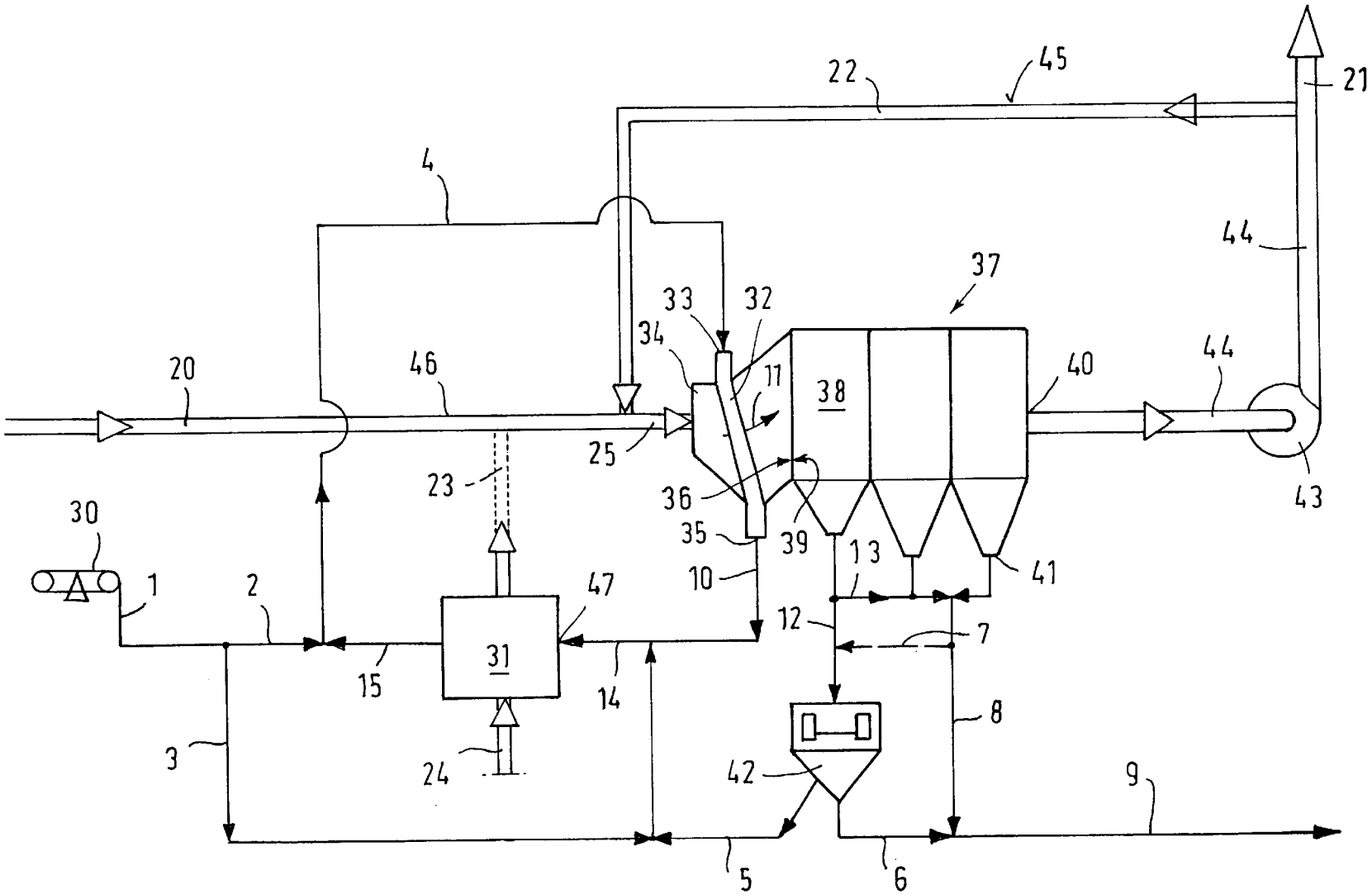
21
43
44
44
9
45
40
41
37
7
8
6
22
13
38
39
12
42
5
32
11
33
34
36
35
10
25
14
47
31
23
24
4
46
15
2
3
20
1
30

MILLING INSTALLATION

BACKGROUND OF THE INVENTION

The invention relates to a milling installation for the generation of meal-fine products, in particular for the generation of cement raw meal and/or of cement from cement clinkers, with a comminuting device for the comminution of the raw materials, a sifter for the separating-off of the fine material generated in the comminution from the still-present coarse material and with a fine material separating device for the separating-off of the fine material from the sifting air of the sifter.

As a comminuting device in known milling installations for the comminution for meal fineness there are predominantly used impact hammer millers, tube mills, or a roller press, when raw material is to be milled into the fineness range of cement raw meal or of cement and when a relatively great throughput is desired.

Downstream of these comminuting devices there is then ordinarily engaged a sifter, in which the comminuted raw material is sifted at the desired grain size, with the aid of sifting air, i.e., is separated. The sifters used there are, according to the problem definition, dynamic or static sifters. In the sifter the still too coarse comminution material is separated from the sufficiently comminuted fine material, conveyed out of the sifter over a sluice and then returned to the comminuting device. The fine material leaves the sifter with the sifting air and is thereupon separated from the sifting air in a corresponding device. This device is ordinarily a further sifter with a downstream-engaged dedusting device.

In order to keep the dedusting gas amounts as low as possible, it is a known practice there to return a major portion of the purified sifting air to the sifter in a closed circuit.

In the so-called milling drying in which, with the aid of the sifting air, moist raw substances are dried during their comminution and/or their sifting, hot gases are used as sifting air such as, for example, furnace exhaust gas, cooler exhaust gas or hot gases of a hot-gas generator. In these cases then the amount of the returned sifting air for thermal reasons—fresh hot gas is needed for the drying—is decreased or altogether no sifting air is returned any longer.

Especially for the generation of cement raw meal and for the comminution of cement clinkers in known milling installations in recent time a so-called V-sifter has been used which, as a static sifter without driven components, is distinguished by a low specific energy requirement.

Thus in EP 0650763 BI a circulating milling installation is described in which raw material is milled with the aid of a roller press to cement raw meal fineness, in which process the sifter used in the milling installation is a static cascade sifter designated as a V-sifter, with two sifting zone-boundary walls enclosed by the shaft-form sifter-housing, and that form a sifting zone between them and are also being traversed by the sifting air in transverse flow, which (walls) have guide plates in cascade or Venetian blind manner inclined obliquely downward in the direction to the discharge opening for the sifted-out coarse fraction, in which system the two guide plate walls, and therewith the interlying sifting zone are arranged to lie obliquely at an angle deviating from the vertical.

The coarse fraction separated off in this V-sifter is led back to the roller press, while the fine material fraction together with the sifting air enters into a cyclone dust separator, which is connected with a second-circulating mill-installation with tube mill and sifter of its own, upon which there follows a dedusting device.

In a publication of the firm of KHD Humboldt Wedag AG ("Improvements in raw meal and cement generation by V-sifter and roller press," Zement-Kalk-Gips No. 3, March 1997, pp. 140–147) there is presented a further example of an application for the use of the V-sifter in the cement raw meal and cement generation. In this example, in the cement raw meal generation the limestone comminuted in a roller press is fed to a V-sifter, in which there occurs a separating of the coarse material from the generated fine material. While the coarse material is returned to the roller press, the fine material with the sifter air passes into an after-engaged cyclone sifter, in the after-engaged cyclone separators of which the finished cement raw meal is separated off in the desired fineness.

Although with the static V-sifter there is available a simply constructed device with low wear characteristics and a low specific energy requirement, still, for example in the milling drying for the generation of a cement raw meal for the furnace feed, the usual specific energy requirement for the milling and dedusting blower remains at 4 to 9 kWh per ton of generated raw meal, which is still relatively high.

SUMMARY OF THE INVENTION

It is the problem of the invention, therefore, to further develop known milling installations with an integrated V-sifter so that without cost-intensive constructive measures there is obtained a clear lowering of the specific energy requirement for the entire milling process.

By means of the invention, by connecting the V-sifter directly to a fine material separating device, preferably to an electro-filter, to form a homogeneous component, without using the otherwise usual pipelines, there is yielded first of all a clear reduction of the specific energy requirement for the entire milling installation, and namely primarily by the elimination of the flow resistance otherwise caused by the pipelines, for the sifting air, which otherwise must be compensated for by an increase in electric drive performance for the blower.

If according to the invention an electro-filter is used, a tube-form filter is likewise possible, then moreover, additional dedusting of the sifting air is no longer necessary, whereby likewise a saving in specific energy is made possible.

Simultaneously with the lowering of the energy costs, additional installation costs are advantageously saved by the elimination of the otherwise usual pipelines and the elimination of the otherwise necessary dedusting device downstream from the separation of the fine material.

By causing the constructive dimensions and attuning of the V-sifter to correspond to those of the fine-material separating device, it becomes possible, for example in the cement raw meal generation in which the meal is dried to maintain the operation of the cyclone heat exchanger furnace, of the milling installation and of the dedusting with only one suction blower.

So that the V-sifter can be directly connected with the fine-material separating device without interposed pipelines, it is necessary to arrange the outlet opening of the V-sifter for the sifting air laden with fine material not as otherwise usual at the upper end of the sifting housing, but laterally on the sifting housing, so that the sifting air at least can also be fed laterally into the fine-material separating device.

BRIEF DESCRIPTION OF THE DRAWINGS

Further advantages, details and features of the invention are explained in the following in a schematic flow diagram of an exemplary installation for the production of cement raw meal by milling drying.

DETAILED DESCRIPTION OF THE PREFERRED EMBODIMENTS

The milling installation represented in this schematic flow diagram is a milling drying installation in which with the aid of hot gas 20, for example furnace or cooler waste gas, moist raw material 1 is dried and simultaneously comminuted, there, to cement raw meal fineness.

Comminution is performed in the example of execution represented in a roller press 31 which is dedusted by fresh air feed 24 and connection to the hot-gas pipeline 23. Downstream of the roller press 31 there are arranged a V-sifter 32 with a directly connecting electro-filter 37 for the separating off of the generated meal-fine finished material 9 with the aid of sifting air 25.

The sifting air 25 is formed from hot gas 20 injected into the milling drying installation as waste gas of an unrepresented cyclone heat-exchanger furnace, and from an admixed partial amount of purified sifting air 22; it enters first into the V-sifter 32, over a hot-gas pipeline 46 through a laterally arranged entry opening 34.

In the V-sifter 32 there now occurs a separation of the material 4 to be sifted, which is introduced into the V-sifter 32 from above, via a material entry opening 33, at the desired separating grain size. The coarse material 10 obtained is discharged via a coarse material discharge opening 35 downward from the V-sifter 32, and the separated fine material 11 flows in common with the sifting air 25 through a lateral outlet opening 36, out of the V-sifter 32 and through a directly following lateral entry opening 39 into an electro-filter 37, which is constructed with a preliminary separating chamber 38. In this electro-filter 37 there now takes place an extensive separating-off of the fine material 11, which is discharged downward over discharge openings 41 out of the electrofilter 37, and the purified sifting air 25 emerges as dedusted waste gas 21 from a lateral outlet opening 40 out of the electro-filter 37. Through a pipeline 44 this waste gas 21 is now discharged from the milling installation via a suction blower 43 which also provides for the necessary sub-pressure for the operation of the heat exchanger furnace and for the operation of the V-sifter 32. A partial amount 22 of this waste gas 21 is branched off to the flow pressure side of the blower 43 and led over a return line 45 to the hot-gas pipeline 46 and mixed there with the hot gas 20. With the aid of the separated-off partial amount 22 of the waste gas 21, therefore, a gas circulation through the V-sifter 32 is maintained, which can be controlled in respect to gas temperature and gas amount over the amount of the recirculated partial amount 22 of the waste gas 21.

So that in the represented milling installation ultimately the entire raw material is comminuted to cement raw meal fineness and is dried sufficiently for placing in the furnace, various material circulations paths are possible between roller press 31, V-sifter 32 and electrofilter 37 for the materials fresh material (moist raw material 1), sifter coarse material 10, and coarse material 5 from the separation material 12 of the preliminary separating chamber 38 of the electrofilter 37. In the following the possible material circulations are described.

The total moist raw material 1 is first fed into the milling installation, over the raw material charging device 30. Depending on moisture and coarseness quality of the raw material, this raw material 1 then represents a partial amount 2 of the sifter load 4 and/or a partial amount 3 of the roller press load 14, i.e., the raw material can be sluiced into the milling circulation at the comminuting device 31 and/or at the sifter 32.

In the feeding into the V-sifter 32, the partial amount 2 of the raw material, together with the total roller press output 15, constitutes the sifter load 4. In the feeding into the roller press 31 the partial amount 3 of the raw material 1 with the coarse material 10 of the V-sifter and possibly with coarse material 5 of the separation material from the preliminary separating chamber 38 of the electrofilter 37 constitute the roller press load 14. The coarse material 5 is separated here from the separating material 12 by a smaller second sifter 42, for example a dynamic sifter. The fine material 6 obtained here has raw meal fineness, and it is fed to the finished material 9. In an electro-filter without preliminary separating chamber, alternatively all of the separation material 7 can be supplied to this second sifter 42. In sufficient fineness of the materials separated off in the electro-filter 37, the discharge 13 of the preliminary separating chamber 38 can be directly brought together with the discharge 8 of the other chambers of the electrofilter 37, to the finished material 9.

The coupling according to the invention of a V-sifter with a fine material separating device to form a compact component is not restricted to the milling installation or milling drying installation for cement raw meal generation using an electro-filter as fine-material separating device; on the contrary, it is usable everywhere in milling installations in which meal-fine products are to be generated by interaction of a comminuting installation with a sifter and a fine-material separating device, and where the technical and local conditions are given for this coupling according to the invention.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A milling installation for the generation of meal-fine products, with a comminuting device, a sifter supplied with sifter air for the separating-off of fine material generated in the comminution device from still-present coarse material, and with a fine material separating device for separating-off the fine material from the sifting air of the sifter, wherein the sifter used in the milling installation is a static cascade sifter designated as a V-sifter with-two sifting zone boundary walls enclosed by a shaft-form sifter housing and forming between them a sifting zone through which the sifting air flows in transverse flow, which walls have guide plates arranged in cascade manner aligned downward in a direction to a discharge opening for sifted-out coarse material, in which the two guide plate walls and therewith the interlying sifting zone are arranged obliquely at an angle deviating from vertical, and the V-sifter with a lateral discharge opening for the sifting air laden with the sifted-out fine material is connected with a lateral input opening of the fine material separating device, in such manner that there is no interposition of a transport device or pipeline, so that V-sifter and fine material separating device form a compact structural unit.

2. A milling installation according to claim 1, wherein the comminuting device is a roller press.

3. A milling installation according to claim 1, wherein at least one separation material discharge opening of the fine material separating device is connected with a further sifter.

4. A milling installation according to claim 1, including a cyclone heat exchanger furnace, which provides heated air directed into said air inlet, wherein the V-sifter and the fine material separating device are dimensionally attuned to one another in such a manner that for the generation of cement raw meal by milling drying, only one blower is required for the operation of the cyclone heat exchanger furnace for the milling installation, the V-sifter and for the fine material sifting device.

5. A milling installation according to claim 1, wherein the fine material separating device includes a sifting air outlet line which is connected via a return line with the sifting air lateral entry opening of the V-sifter.

6. A mill installation according to claim 1, wherein the lower outlet of the V-sifter for the sifted out coarse material is connected with an opening for a loading of the comminuting device.

7. A mill installation according to claim 1, wherein the fine material separating device comprises an electro-filter.

8. A milling installation for the generation of meal-fine products from coarse material, comprising:

a comminuting device generating fine and coarse comminuted material;

a static cascade sifter in the form of a V-sifter having a shaft form sifter housing, a comminuted material inlet communicating with the comminuting device, an air inlet for sifting air and two sifting zone boundary walls forming between them a sifting zone through which the sifting air flows in transverse flow, a lower outlet for sifted out coarse comminuted materials and a lateral discharge opening for the sifter air laden with the fine comminuted material; and a fine material separating device for the separating-off of the fine material from the sifting air of the sifter, said lateral discharge opening of said static cascade sifter being connected with a lateral input opening of the fine material separating device in such manner that there is no interposition of a transport device or pipeline.

9. A milling installation device according to claim 8, wherein said two sifting boundary walls have guide plates arranged in a cascade manner.

10. A milling installation device according to claim 9, wherein said guide plates and the interlying sifting zone formed therebetween are arranged obliquely at an angle deviating from vertical.

11. A milling installation device according to claim 8, wherein said comminuting device is a roller press.

12. A milling installation device according to claim 8, wherein at least one separation material discharge opening of the fine material separating device is connected with a further sifter.

13. A milling installation device according to claim 8, wherein said fine material separating device comprises an electro-filter.

14. A milling installation device according to claim 8, including a cyclone heat exchanger furnace which provides heated air directed into said air inlet, wherein said V-sifter and said fine material separating device are dimensionally attuned to one another in such a manner that for the generation of cement raw meal by milling drying, only one blower is required for the operation of the cyclone heat exchanger furnace for the milling installation, the V-sifter and for the fine material separating device.

15. A milling installation device according to claim 8, wherein the fine material separating device includes a sifting air outlet line which is connected via a return line with the sifting air entry line of the V-sifter.

16. A milling installation device according to claim 8, wherein the lower outlet of the V-sifter for the sifted-out coarse material is connected with an opening for a loading of the comminuting device.

* * * * *